United States Patent [19]

Cosmos et al.

[11] Patent Number: 4,687,263

[45] Date of Patent: Aug. 18, 1987

[54] SHIELDING KIT FOR ELECTRICAL CONNECTORS TERMINATING MULTICONDUCTOR 360 DEGREE SHIELDED CABLE

[75] Inventors: Pete Cosmos, Mechanicsburg; Michael J. Scully, Harrisburg; Brian D. Stephenson, Camp Hill, all of Pa.

[73] Assignee: AMP Incorporated, Harrisburg, Pa.

[21] Appl. No.: 868,897

[22] Filed: May 27, 1986

Related U.S. Application Data

[63] Continuation of Ser. No. 474,116, Mar. 10, 1983, abandoned.

[51] Int. Cl.[4] ..... H01R 13/648; H01R 4/24; H01R 13/58

[52] U.S. Cl. ..... 439/108; 439/423; 439/465; 439/607; 439/499

[58] Field of Search ..... 339/14 R, 17 F, 17 LC, 339/103 M, 107, 136 R, 136 M, 138, 143 R, 176 MF, 95 R, 96, 97 C, 103 R; 174/84 C

[56] References Cited

U.S. PATENT DOCUMENTS

| | | | |
|---|---|---|---|
| Re. 27,743 | 8/1973 | Weimer, Jr. | 174/94 |
| 3,138,658 | 6/1964 | Weimer | 174/94 |
| 3,247,316 | 4/1966 | Weimer, Jr. | 174/94 |
| 3,504,101 | 3/1970 | Muto | 174/94 |
| 3,541,226 | 11/1970 | Cea et al. | 174/84 |
| 3,541,227 | 11/1970 | Bendrick | 174/94 |
| 3,723,942 | 3/1973 | Dennison | 339/14 R |
| 3,728,661 | 4/1973 | Kassabgi | 339/17 F |
| 3,740,698 | 6/1973 | Jerominek | 339/103 M X |
| 3,852,700 | 12/1974 | Haws | 339/14 R |
| 4,002,392 | 1/1977 | Hardesty | 339/99 R |
| 4,083,615 | 4/1978 | Volinskie | 339/176 M X |
| 4,111,512 | 9/1978 | Parmer et al. | 339/105 |
| 4,178,051 | 12/1979 | Kocher et al. | 339/45 M |
| 4,209,215 | 6/1980 | Verma | 339/143 R X |
| 4,323,295 | 4/1982 | Davis, Jr. | 339/107 |
| 4,337,989 | 7/1982 | Asick et al. | 339/143 R |
| 4,386,814 | 6/1983 | Asick | 339/14 R |
| 4,418,972 | 12/1983 | Benasutti | 339/14 R |
| 4,420,201 | 12/1983 | Stephenson | 339/143 R X |
| 4,457,575 | 7/1984 | Davis et al. | 339/143 R |
| 4,544,227 | 10/1985 | Hirose | 339/143 R |

FOREIGN PATENT DOCUMENTS

| | | | |
|---|---|---|---|
| 6711008 | 2/1969 | Netherlands | 339/107 |

*Primary Examiner*—Gil Weidenfeld
*Assistant Examiner*—Steven C. Bishop
*Attorney, Agent, or Firm*—Bruce J. Wolstoncroft

[57] ABSTRACT

A shielding kit for providing 360° shielding of a connector terminating multi-conductor flat 360° shielded cable includes a plug shield of at least two interfitting metal members which enclose the plug and secure the shielding grids of the cable and an at least one part shielding adapter which is fitted on a standard receptacle serving to ground the shielded plug when mated therein. The kit also includes a cable strain relief cover formed by a pair of hermaphroditic insulative members. The kit further includes an embodiment for use with daisy chain arrangement which is a three piece assembly to include both sides of the mating face of the cover as well as the back face of the plug. This embodiment can be used with or without the above mentioned strain relief cables. The receptacle portion of the mated plug can be enclosed by any of a variety of various shielding members.

11 Claims, 15 Drawing Figures

Fig. 11
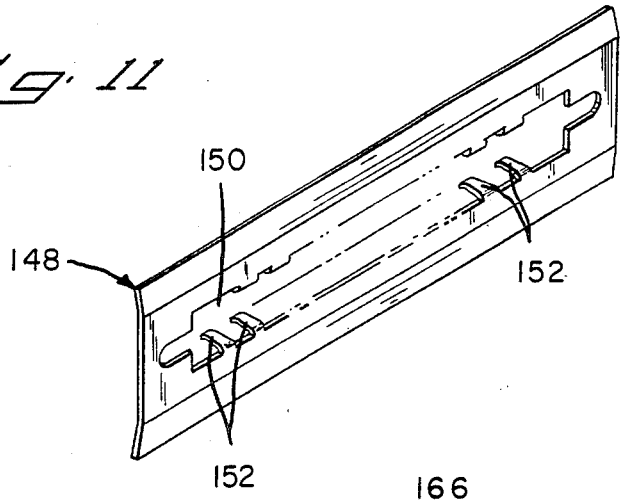
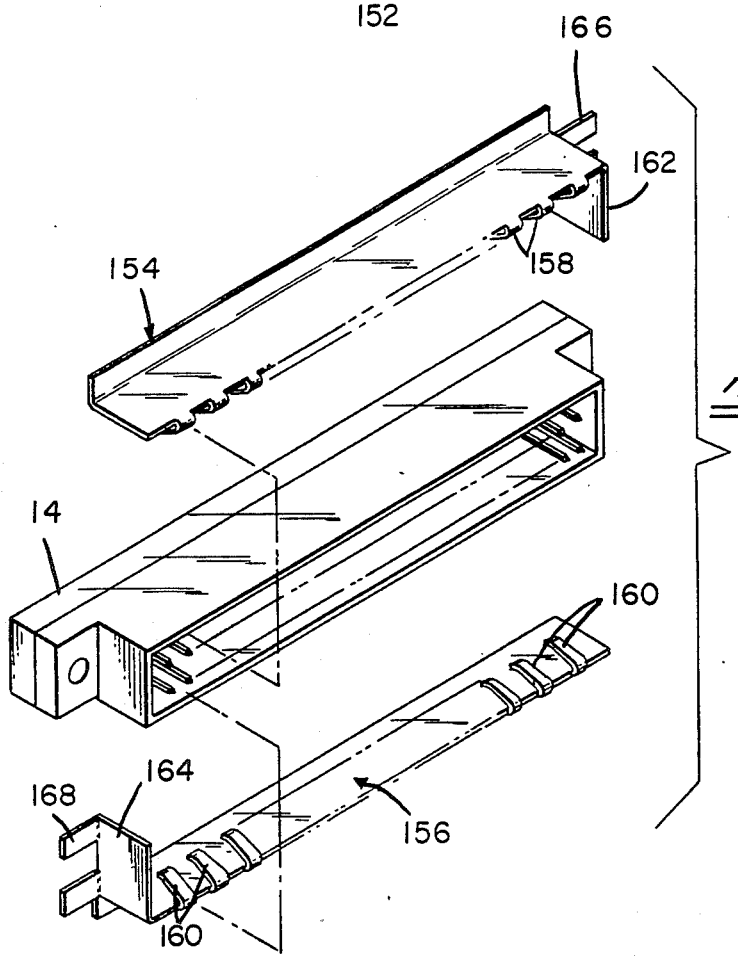
Fig. 12

SHIELDING KIT FOR ELECTRICAL CONNECTORS TERMINATING MULTICONDUCTOR 360 DEGREE SHIELDED CABLE

This is a continuation of application Ser. No. 474,116, filed Mar. 10, 1983, now abandoned.

A shielding kit is disclosed for use with an electrical connector terminating a 360° shielded cable, which shielding kit can be used either at an end of the cable or intermediate the ends in a daisy chain configuration. In particular, the subject kit includes a number of embodiments enabling retrofit of a standard receptacle to mate with a shielded connector to ground the shielding thereof.

The increasing concern over the effects of unwanted radio frequency and electro-magnetic interference in electronic systems has caused the creation of a series of new requirements to prevent and/or limit RF/EMI radiation and/or to shield systems to prevent them from being adversely affected. It is quite easy to provide a shielded cable to protect against RF/EMI between two points, but there is a continuing problem of exactly how to ground the shielded cable and in particular to handle the many various types of 360° shielded cable. Part of the problem involved is with the actual separation of the conductors from the shielding and another part is how to terminate the shielding in such a manner as to effectively form a ground path between the shielding and any equipment housing or the like. Considering the cable first, there are some cables that have shielding bonded into the outer insulative jacketing. These are very difficult to terminate since it is necessary to strip away the insulation very carefully to get to the shielding without damaging it. A second type of cable has a loose outer jacket of insulation closely fitted over webs of metallic screening which form the shielding. While these are somewhat more easily terminated, they are rather bulky and clumsy to handle. They also come in a wide range of thicknesses.

A further problem concerns retrofitting existing equipment which must be shielded. While the existing cables can be readily replaced by shielded cables and the plug connectors replaced by shielded plug connectors, this causes more problems with the receptacle portions of the connectors. These normally have already been installed in circuit boards, equipment base panels, and the like and are not as easy to retrofit as simply replacing a cable. There is a certain point where retrofitting is more economical than entirely replacing or revamping the full system.

The present invention comprises a shielding assembly for enclosing a plug terminating a multi-conductor flat fully shielded cable and having means for attaching the shielding of the cable to the plug assembly. The kit further includes at least one shielding member which can be applied to a standard receptacle and attached to ground to ground the shielding of the mating plug when received therein. An embodiment of the plug assembly is comprised of three metallic members and can be used to shield a plug terminating the shielded cable in a daisy chain fashion. Two assembly pieces encase the mating face of the plug and engage the shielding on one side of the cable while the third piece encloses the rear of the plug and joins the opposite layer of shielding. Any of the plug embodiments can be equipped with a strain relief cover formed by a pair of hermaphroditic insulative members having a strain relief feature which accommodates a wide variety of cable thicknesses. The receptacle shielding member can be formed in one or several metal pieces and include features allowing the receptacle shielding to be directly grounded to the associate circuit board as well as to be connected by a secondary cable to a remote ground.

Several embodiments of the present invention will now be described by way of example with reference to the accompanying drawings in which:

FIG. 11 is a perspective view of a receptacle shield embodiment, according to the present invention for a panel mounted receptacle;

FIG. 12 is an exploded perspective view of an alternate embodiment of a receptacle shield in accordance with the present invention and a different style of known receptacle;

Figure 1:
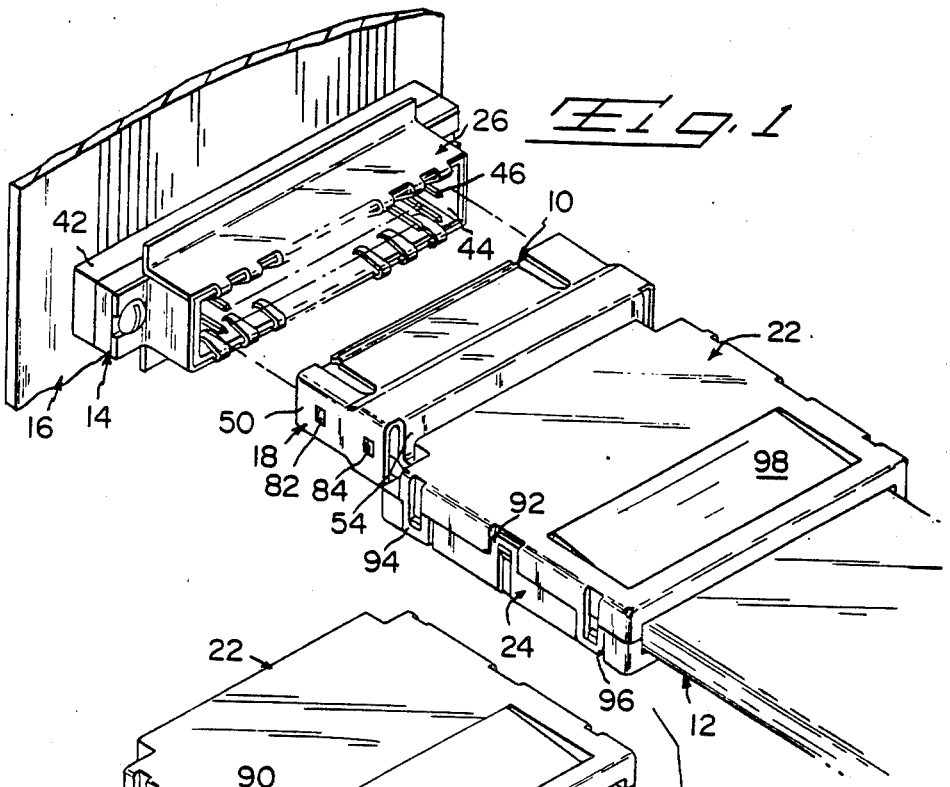
FIG. 1 is a perspective view of an unmated electrical connector provided with RF/EMI shielding in accordance with the present invention.
Figure 2:
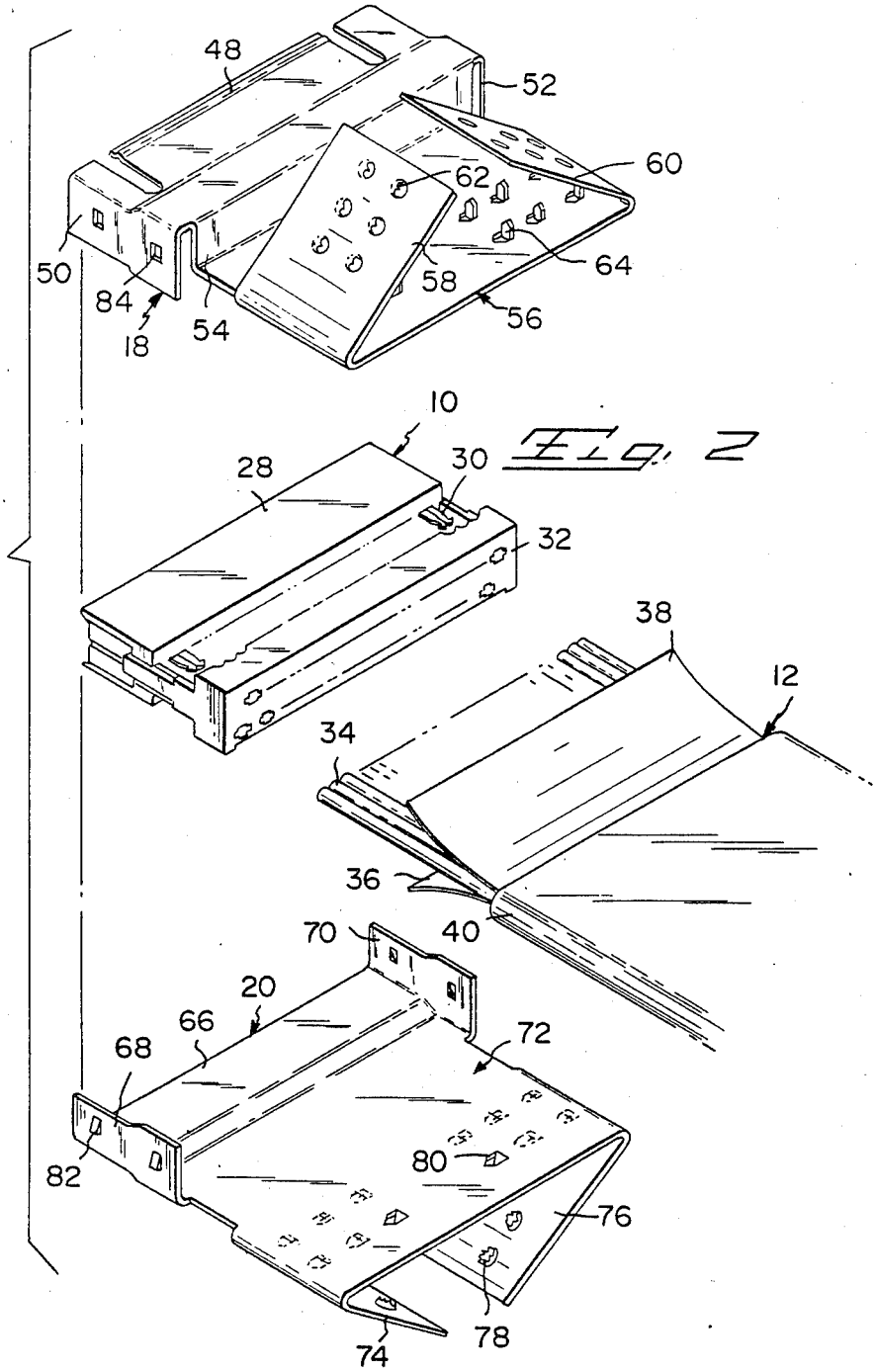
FIG. 2 is an exploded perspective view of the plug portion of the electrical connector of FIG. 1 together with a 360° shielded cable and the shielding of the present invention.

Referring now to FIG. 1 and FIG. 2, the present invention is used in combination with a known electrical connector plug 10 terminating a 360° shielded cable 12 and mating in a receptacle 14 mounted on a circuit board 16. The subject invention includes a plug shielding assembly 18, 20, optional hermaphroditic strain relief covers 22, 24, and a receptacle shield 26. The plug connector 10 shown in the present drawings can be any of a number of well known multi-conductor plug connectors, for example, the one shown in U.S. Pat. No. 4,111,512, the disclosure of which is incorporated herein by reference. Likewise the receptacle 14 can be any of the many standard known configurations, such as the one shown in U.S. Pat. No. 4,178,051, the disclosure of which is incorporated herein by reference.

The connector plug 10 is formed by a housing 28 of insulative material containing a plurality of insulation piercing terminals 30 and a cover 32. The cable 12 is made up of a plurality of insulated conductors 34 enclosed between layers of conductive shielding 36, 38 and covered by an outer insulative sheet 40, which is preferably closely fitted over the shielding but not adhered thereto. The receptacle 14 is an elongated insulative member 42 having a plug receiving cavity 44 containing a plurality of pin terminals 46 which are engaged with appropriate circuitry of the circuit board 16 by any of the well known means, such as solder.

Figure 3:
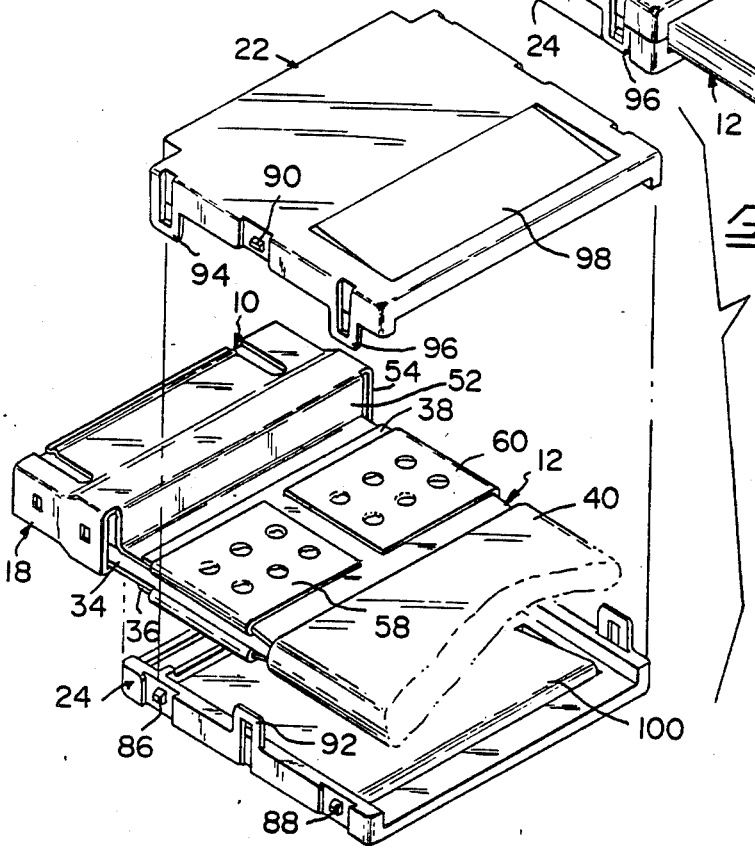
FIG. 3 is a perspective view of the plug of FIG. 1 in an assembled condition and with a pair of strain relief covers exploded therefrom.

The plug connector shielding assembly is formed by a pair of mating members 18, 20 which are stamped and formed from conventional metal stock material. The member 18 has an outer wall 48, a pair of integral depending end walls 50, 52 and an integral depending rear wall 54 from which a T-shaped cable shield engaging flange portion 56 extends. The arms 58, 60 of the flange 56 are adapted to be folded upon themselves, as shown in FIG. 2, to trap the shielding 38 therebetween, by means of the apertures and projections 62, 64, respectively, as shown in FIG. 3. The member 20 is somewhat similar to member 18 in that it has an outer wall 66, integral end walls 68, 70, and an integral T-shaped flange 72 having arms 74, 76 which are adapted to be folded upon themselves to entrap the shielding layer 36 therebetween by means of the projections 78 and the apertures 80. The members 18, 20 also have lugs 82 and apertures 84 to secure the members together.

The walls 48, 50, 52, 54, 66, 68, and 70 define a cavity to enclose the plug connector 10. The plug connector 10 shown normally has the terminated cable extending perpendicular to the longitudinal axis of the connector. In this embodiment the cable extends parallel to the axis. The flanges 56, 72 must lie to one side of the axis of the connector as best appreciated from FIGS. 1 to 3. The termination of the shielding 36, 38 effected by the respective projections 64, 80 and apertures 62, 78 is more fully discussed in U.S. Pat. Nos. 3,138,658; 3,247,316; 3,504,101; 3,541,226; 3,541,227; and Re. 27,743, the disclosures of which are incorporated herein by reference.

An optional strain relief cover is formed by a pair of hermaphroditic members 22, 24, which are formed of a fairly rigid insulative material. Each cover 22, 24 has latching means on its lateral edges including lugs 86, 88, 90 and depending latching straps 92, 94, 96. Each cover 22, 24 is also provided with a central cantilever flange 98, 100 which is formed to normally extend into the cavity 102 defined by the mated covers 22, 24 (see FIG. 5) and inclined in a direction away from the associate connector plug 10. The covers 22, 24 are applied simply by snapping them together on opposite sides of the cable. The respective flanges 98, 100 are able to apply sufficient strain relief force and yet to cover a wide range of cable thicknesses. This can best be appreciated from FIG. 5, which shows the covers in section.

Figure 4:
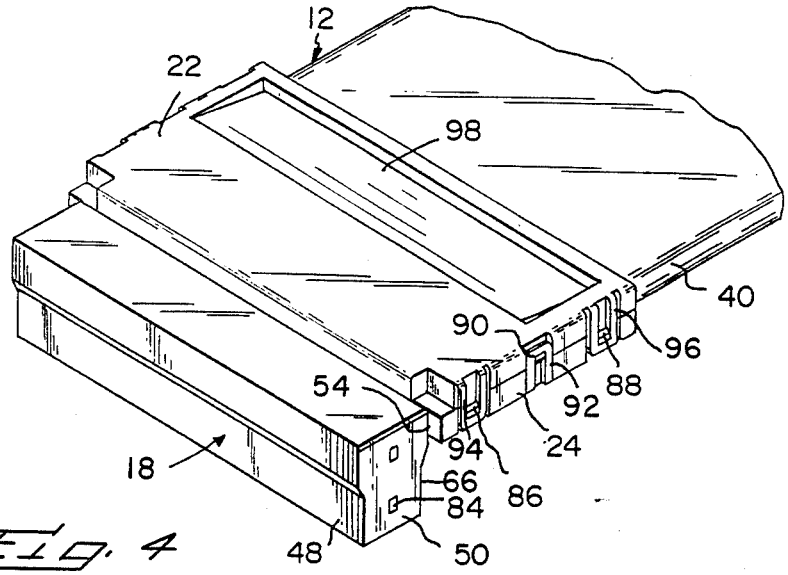
FIG. 4 is a perspective view of an alternate embodiment of the present invention for a right angle plug connector.
Figure 5:
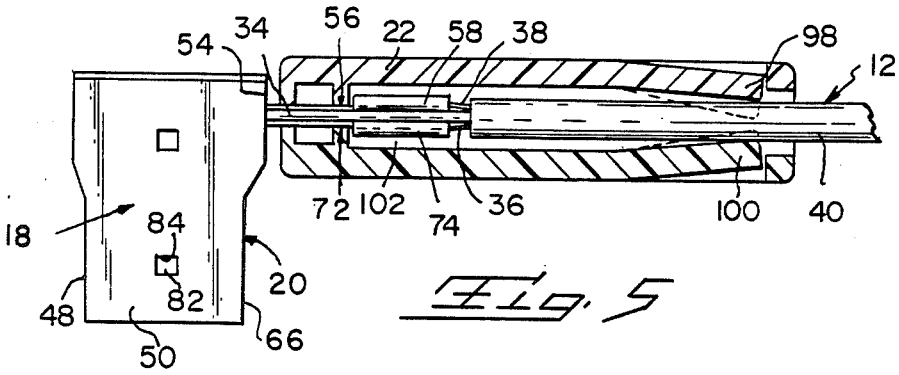
FIG. 5 is a side elevation, partially in section, of the plug connector of FIG. 4.

FIGS. 4 and 5 also illustrate a right angle embodiment of the subject connector shielding. This embodiment is substantially the same as the previously described embodiment of FIGS. 1 to 3, the exception being the direction in which the T-shaped flanges 56, 72 extend from their respective shield members 18, 20.

Figure 6:
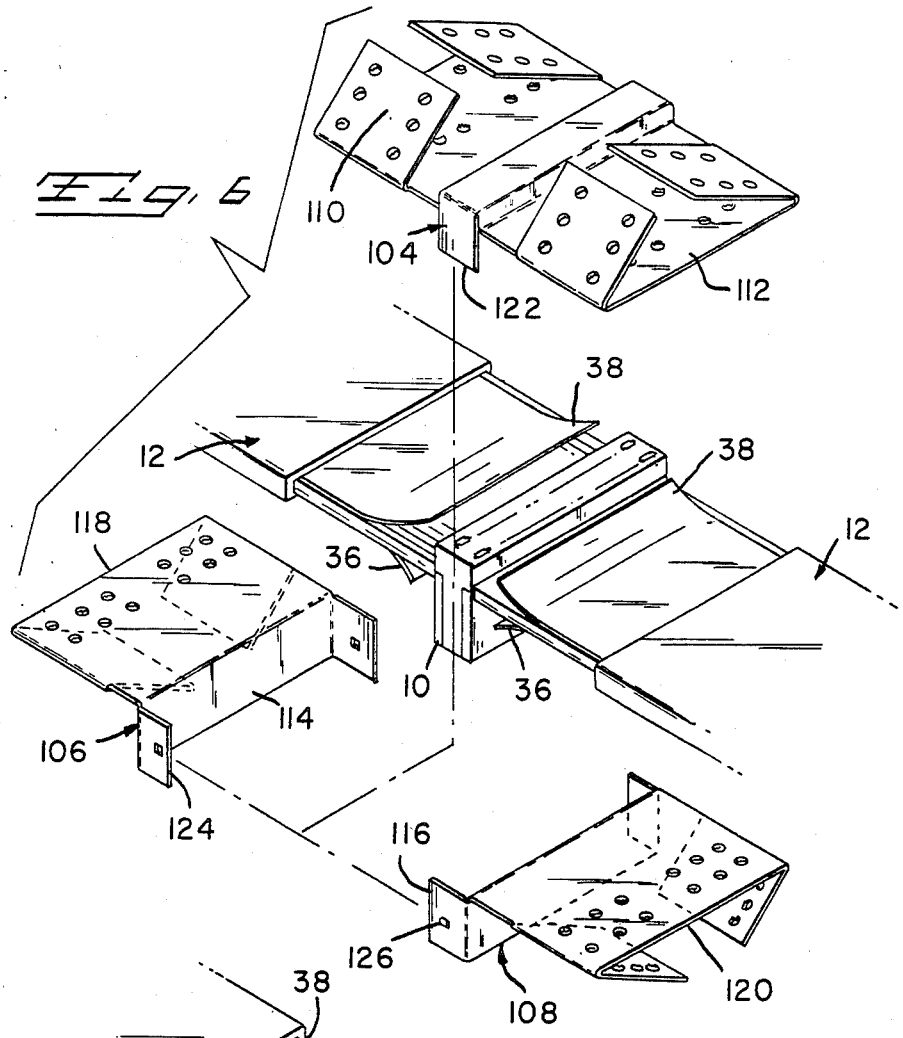
FIG. 6 is an exploded perspective view of a daisy chain shielding embodiment of the present invention and a shielded cable terminated intermediate its ends by a conventional connector.
Figure 7:
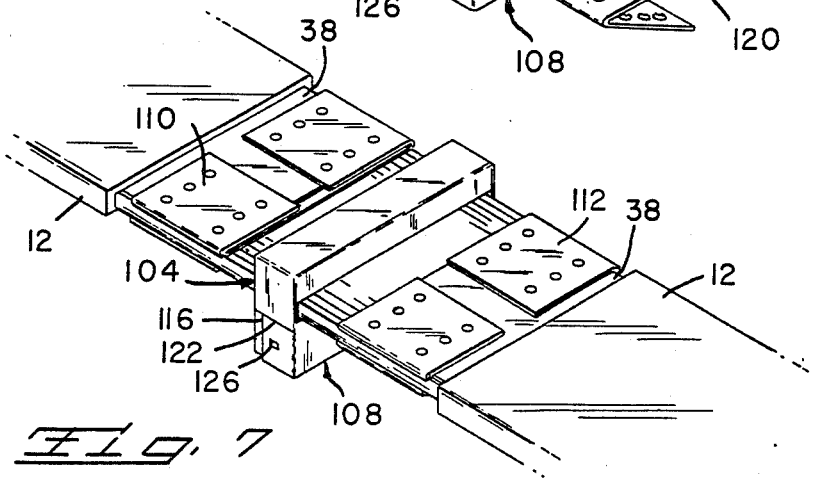
FIG. 7 is a perspective view of the embodiment of FIG. 6 in a fully assembled condition.

FIGS. 6 and 7 show an embodiment of the present invention which is used to provide shielding for a connector which has been attached to a shielded cable intermediate the ends thereof in what is generally termed daisy chain fashion. In this instance the receptacle connector 10 has been mounted on an intermediate portion of cable 12 in standard fashion with the cut ends of shielding 36, 38 lying to each side of the connector. In this instance the plug shield assembly is tripartite having a back shell 104, a first front shell 106, and a second front shell 108. The back shell 104 is profiled to receive the rear portion of the connector plug that extends to one side of the cable. A pair of T-flanges 110, 112 are provided on shell 104 and extend in opposite directions therefrom along the length of the cable 12. Each front shell 106, 108 includes a portion 114, 116 which is profiled to enclose the portion of the plug connector 10 extending from the opposite side of the cable 12. Shells 106, 108 also have integral T-flanges 118, 120. It should be noted that the back shell 104 and front shells 106, 108 are provided with interlocking means 122, 124, 126 and that all of the T-shaped flanges 110, 112, 118, 120 are similar to the previously described T-flanges 56, 72.

FIG. 7 shows the fully assembled daisy chain shielding embodiment with the back shell 104 joining the shield 38 to one side of the connector plug 10 and the front shells 106, 108 joining the shield 36 while the three shells together enclose the connector plug 10. It should be here noted that the strain relief covers shown in FIGS. 1 to 5 can be applied to this daisy chain embodiment.

Figure 8:
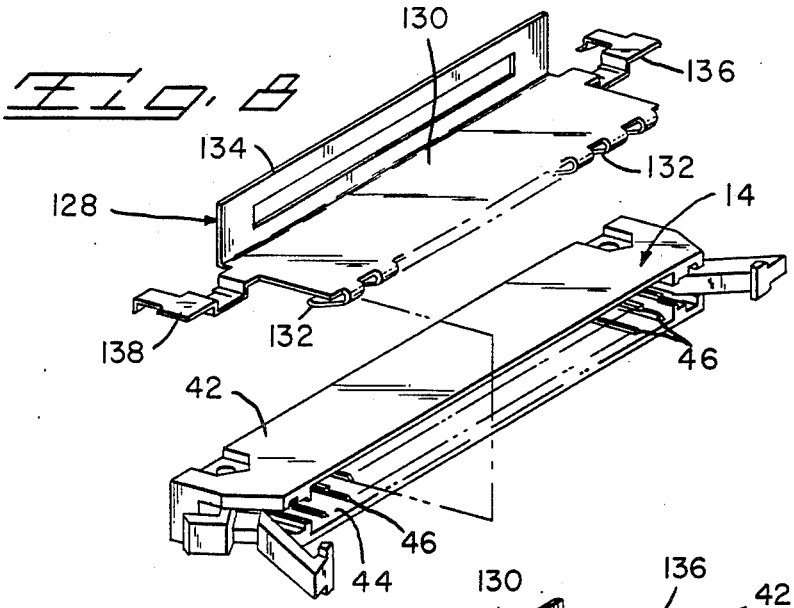
FIG. 8 is an exploded perspective view of an embodiment of a receptacle shield in accordance with the present invention and a known receptacle.
Figure 9:
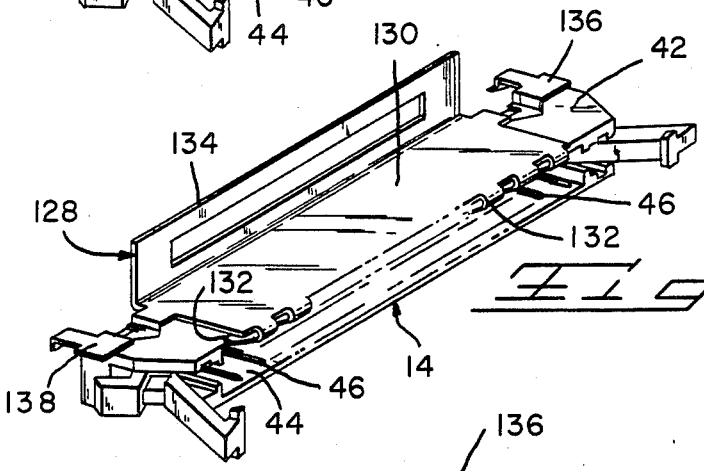
FIG. 9 is a perspective view of the receptacle shield and receptacle of FIG. 8 in an assembled condition.
Figure 10:
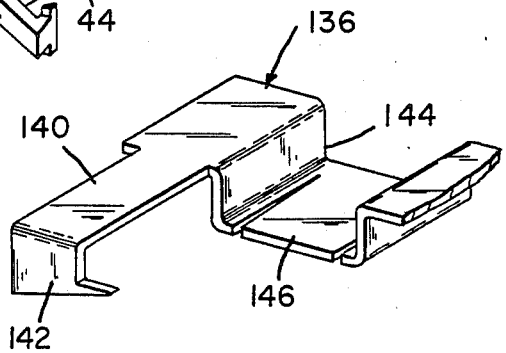
FIG. 10 is a perspective view detailing one end of the receptacle shield of FIGS. 8 and 9.

FIGS. 8 to 15 show a number of embodiments of shielding according to the present invention for application to known connector receptacle 14. In FIGS. 8 and 9, the receptacle 14 is the same as the one shown in U.S. Pat. No. 4,178,051, the disclosure of which is incorporated herein by reference. The grounding shield 128 shown in FIGS. 8 to 10 is an elongated stamped and formed metal member 130 having a plurality of cantilever fingers 132 folded back upon the member 130 so as to lie in the cavity 44 of the receptacle 14. The grounding shield 128 is also provided with an apertured flange 134 which can be used to attach a cable or braid (not shown) to ground the receptacle and shield to a remote location. The grounding shield 128 is also provided with end flanges 136, 138. End flange 136 is shown in greater detail in FIG. 10 and includes a leg 140 extending in the plane of the member 130 with a time 142 extending normal to the plane from the end of the leg. The end flange 136 includes a step 144 having a beam 146. The leg 140 is of sufficient length to wrap around the bottom of the receptacle 14 so that the tine 142 will extend into the mounting aperture and be contacted by the normal receptacle mounting hardware (not shown) and connected to ground. The beam 146 likewise can be folded into a further aperture in the receptacle 14 to contact other mounting hardware (not shown) and establish a ground path. While only one grounding shield 128 is shown in FIGS. 8 and 9, clearly a like shield could be provided on the opposite side of the receptacle to effect more complete shielding.

FIG. 11 shows a shield 148 which would be used over a panel mounted receptacle (not shown). This shield is an elongated metal member having an elongated central aperture 150 with a plurality of tines 152 extending normal to the plane of the member. Elongated metal member or shield 148 is configured to have a slight curvature across its width, as shown in FIG. 11. This shield 148 would simply be mounted over the face of a panel mounted receptacle with the tines 152 extending into a receptacle so as to make a wiping contact between the shielded plug connector 10 inserted therein. The curvature of shield 148 allows the curved ends to cause a wiping action with the panel (not shown) as shielded plug connector 10 is inserted into the receptacle.

Figure 13:
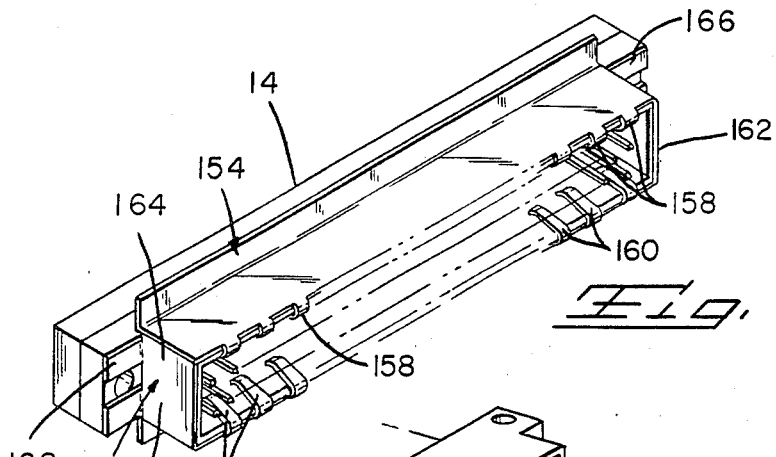
FIG. 13 is a perspective view of the receptacle shield and receptacle of FIG. 12 in a fully assembled condition.

FIGS. 12 and 13 illustrate an alternate embodiment of a ground shield for the receptacle connector in accordance with the present invention. In this embodiment the receptacle 14 is the same as the one shown in FIG. 1. The ground shield is formed by two identical metal members 154, 156. Each member 154, 156 has a plurality of tines 158, 160 extending from one marginal edge of the respective member and bent on the member to lie inside the cavity of the receptacle 14. Extending from the opposite marginal edge is a flange which cooperates with a board not shown. The flange forms less than a ninety-degree angle with the shield, allowing a wiping action to occur between the shield and the board as the shield is secured thereto. The members 154, 156 each also include integral end walls 162, 164 and mounting tabs 166, 168. It is within the perview of the present invention to provide the end walls 164, 166 with an overlapping locking feature so that the two shields together will form a complete 360° shield around the receptacle without creating any undesirable slots. The mounting tabs 166, 168 would be contacted by the normal mounting hardware (not shown) for the receptacle to complete the path from the shield to circuit ground.

Figure 14:
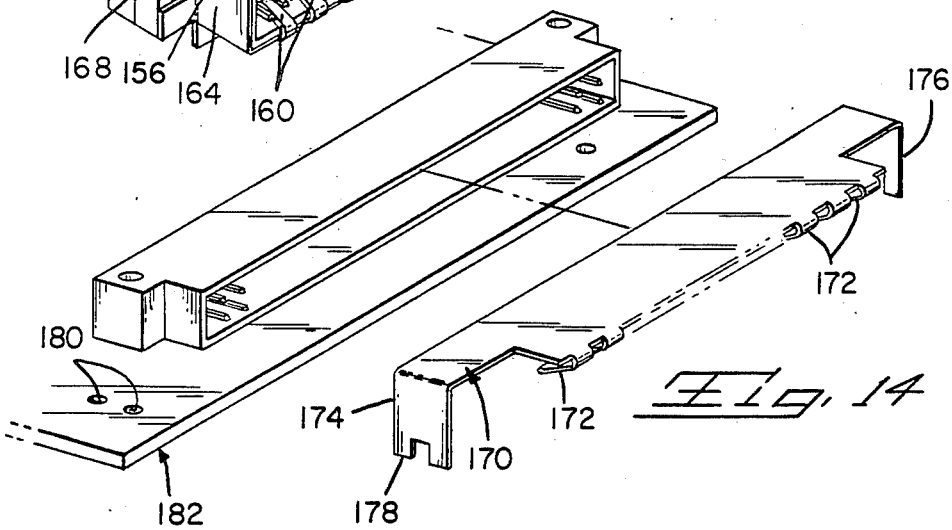
FIG. 14 is an exploded perspective view of another alternate embodiment of the receptacle shield according to the present invention for a right angle receptacle mounted on an edge portion of a circuit board.
Figure 15:
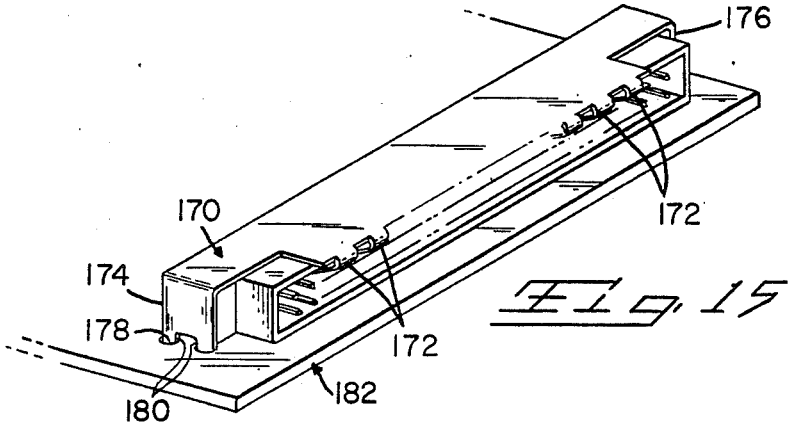
FIG. 15 is a perspective view of the receptacle shield and receptacle of FIG. 14 in an assembled condition.

The embodiment of FIGS. 14 and 15 is quite similar to that of FIGS. 12 and 13 with the exception that the single ground shield 170 has tines 172 folded thereover and end mounting walls 174, 176 each of which is provided with tabs 178 which are received in and joined in respective holes 180 of an associate circuit board 182 and joined to the ground path thereof.

From the foregoing it will be appreciated that the present invention can be retrofitted onto any known receptacle which can be connected with a new shielded cable fitted with the present shielding enclosing known plug connectors. Thus, the present invention can be readily adapted for use as a retrofit as well as to be designed into newly developed and produced equipment.

What is claimed is:

1. An RF/EMI shielding kit for enclosing both the plug and receptacle portions of an electrical connector, comprising a flat multi-conductor cable enclosed within 360° of conductive shielding and an outer insulative sheath, a ground path for said shielding kit, a plug shield assembly formed by at least two mating metal shells together defining a connector plug receiving cavity therebetween, each said shielding shell having an integral T-shaped flange extending from one side thereof in the direction of the cable with the cross bar portion lying normal to the axis of the cable, the length of said cross bar portion being approximately twice the width of said cable shield and being provided with a patterned array of projections and corresponding apertures formed in said cross bar portion, each aperture surrounded by a plurality of tines, all said tines and said projections extending from a single face of said flange, said cross bar portion being adapted to be folded upon itself to entrap a shielding layer of said cable therebetween with said projections engaging respective apertures;

a receptacle shield assembly formed by at least one metal member having a plurality of tines extending from at least one marginal edge and folded back upon said member to lie within the cavity of said receptacle, said member at least partially enclosing the outer periphery of said receptacle, and means for connecting said member to ground;

wherein said at least two mating metal shells comprise first and second mating front shells together defining a cavity receiving a front portion of said connector plug, and a back shell defining a cavity receiving a rear portion of said connector plug, said first and second mating front shells each having an integral T-shaped flange and said back shell having a pair of oppositely directed T-shaped flanges whereby a connector plug terminating a fully shielded cable intermediate its ends can be fully shielded with the first and second front shells engaging the shield on one side of the cable and the back shell engaging the shield on the other side of said cable.

2. An electrical connector assembly for electrically terminating first and second multiconductor shielded planar cable in a daisychain manner, comprising:

electrical connector means having terminals secured therein, the terminals having terminating means for termination of the terminals to respective conductors of the shielded cable;

first and second shield members positioned on either side of the connector means on the side of the cable on which a mating face of the connector means lies, the shield members having first and second sections;

a third shield member positioned on both sides of the connector means on the opposite side of the cable from the first and second shielding members, the third shield member having a first section disposed along the connector means and second sections on either side of the connector means;

latching means being provided by the first sections of the first, second and third shield members such that the first sections cooperate to latchably mate with each other thereby encompassing the electrical connector means;

the second sections extending in the direction of the first and second planar cable respectively, such that the second sections have shield terminating means which terminate the shielding means of the shielded cable to the second sections; and first and second matable cover members, one on either side of the connector, positioned to surround the second sections of the shield members as well as a portion of the cable, latching means provided by the cover members latchably securing them to each other, the cover members having an integral strain relief means which cooperates with the portion of the first and second cable respectively to provide strain relief therefor.

3. An electrical connector assembly as recited in claim 2 wherein the shield terminating means is provided with a patterned array of projections and corresponding apertures, each aperture surrounded by a plurality of tines such that when the terminating means is terminated to the shielding means, the projections and apertures are aligned to entrap the shielding means.

4. An electrical connector assembly as recited in claim 2 wherein the strain relief means is a rigid cable engaging section hingedly connected to each cover member and inclined away from the cover member, such that when two cover members are latched together, the strain relief means can accommodate a wide variety of cable thicknesses.

5. An electrical header for electrical connection with a matable electrical connector comprising:

dielectric housing means having electrical terminal means secured therein, the terminal means having contact sections disposed in a cavity of the housing means;

elongated metal shielding means;

a plurality of tines extending outwardly from the shielding means and bent at an angle with respect to the shielding means so as to extend into said cavity along at least one of the walls of the cavity for making electrical connection with a shielding member of the matable electrical connector;

a flange extending from a side of the shielding means opposite the tines, the flange being essentially perpendicular to the shielding means and is provided with an opening to allow an external ground to be inserted through the opening; and securing means extending from the shielding means, the securing means provided to secure the shielding means to the dielectric housing means.

6. A electrical header as recited in claim 5 wherein the securing means comprises a projection which engages a corresponding hole on the header, and an arm having a tine at the end thereof such that, as the arm is bent, the tine engages a complementary hole of the header.

7. An electrical header for electrical connection with a matable electrical connector, comprising:

dielectric housing means having electrical terminal means secured therein, the terminal means having contact sections disposed in a cavity of the housing means;

two identical elongated metal shielding means which cooperate to enclose the matable electrical connector;

a plurality of tines extending outwardly from the shielding means and bent at an angle with respect to the shielding means so as to extend into said cavity along at least one of the walls of the cavity for making electrical connection with a shielding member of the matable electrical connector;

a flange extending from a side of the shielding means opposite the tines, the flange forming less than a ninety-degree angle with the shielding means such that a wiping action can take place between the shield and a board as the shielding means is secured; and securing means extending from the shielding means, the securing means provided to secure the shielding means to the dielectric housing means, the securing means having a wall extending essentially perpendicular to the shielding means, the wall having a tab section positioned essentially perpendicular to the wall, a screw receiving slot provided on the tab for cooperation with a screw to secure the housing means, the securing means, and the board together, providing a grounding path for the shielding means.

8. an electrical header for electrical connection with a matable electrical connector, comprising:

dielectric housing means having electrical terminal means secured therein, the terminal means having contact sections disposed in a cavity of the housing means;

elongated shielding means;

a plurality of tines extending outwardly from the shielding means and bent at an angle with respect to the shielding means so as to extend into said cavity along at least one of the walls of the cavity for making electrical connection with a shielding member of the matable electrical connector; and securing means extending from the shielding means and being bent perpendicular to the plane of the shielding means, the securing means provided to secure the shielding means to the dielectric housing means, the securing means having pin-like projections extending from the end, the projections cooperating with holes of a circuit board to secure the header to the board and to provide a grounding path for the shield means.

9. An electrical connector assembly for electrically terminating a multiconductor shielded planar cable, comprising:

electrical connector means having terminals secured therein, the terminals having terminating means for termination of the terminals to respective conductors of the shielded cable;

first and second matable shield members having first and second sections, latching means being provided by the first sections latchably mating them together to encompass the electrical connector means, the first sections cooperating to form an opening through which electrical terminal members of a mating section of a complementary connector means can extend, the second sections extending from the first sections in the same direction as the shielded cable, such that the second sections have shield terminating means which terminate shielding means of the shielded cable to the second sections;

the shield terminating means having a base portion and arm portions, the arm portions extending from opposite sides of the base portion;

the base portion having a patterned array of openings extending therethrough, adjacent the openings are piercing projections;

the arm portions having a patterned array of openings extending therethrough, adjacent the openings and spaced in surrounding relationship thereto are a plurality of tines, such that as the shielding means of the cable is terminated, the openings of the arm portion align with the piercing projections of the base portion, allowing the shield means to be pierced which in turn allows the arm portions to properly close on the shield means, ensuring a reliable connection between the shield terminating means and the shield means;

matable cover members positioned to surround the first and second terminated shield members as well as a portion of the cable, latching means provided by the cover members having an integral strain relief means which cooperates with the portion of the cable to provide strain relief therefor; and the strain relief means is a rigid member hingedly connected to each cover member and inclined inward, away from the cover member, the rigid member has a cable engaging section positioned at a free end thereof, such that when two cover members are latched together, the cable engaging sections engage the cable and adjust according to the size of the cable, thereby allowing the strain relief means to accommodate a wide variety of cable thicknesses.

10. An electrical connector assembly as recited in claim 9 wherein a mating face of the electrical connector means is lying in the direction of the cable.

11. An electrical connector assembly as recited in claim 9 wherein a mating face of the electrical connector means is lying normal to the direction of the cable.

* * * * *